United States Patent [19]

Bluhm

[11] 3,931,763

[45] Jan. 13, 1976

[54] EXPLOSIVE PRIMING DEVICE

[75] Inventor: Harold Frederick Bluhm, Allentown, Pa.

[73] Assignee: Atlas Powder Company, Wilmington, Del.

[22] Filed: Sept. 24, 1974

[21] Appl. No.: 508,872

[52] U.S. Cl. ..... 102/28 R; 102/24

[51] Int. Cl.[2] ..... F42B 3/10

[58] Field of Search ..... 102/24, 28

[56] References Cited

UNITED STATES PATENTS

| | | | |
|---|---|---|---|
| 2,913,982 | 11/1959 | Hayes | 102/24 |
| 3,491,687 | 1/1970 | Cholet | 102/24 |
| 3,628,455 | 12/1971 | Nelson | 102/28 |
| 3,747,527 | 7/1971 | Griffith | 102/24 |

*Primary Examiner*—Verlin R. Pendegrass
*Attorney, Agent, or Firm*—Connolly & Hutz

[57] ABSTRACT

A priming device for initiating explosive compositions. The device includes an elongated shell preferably formed of a synthetic plastic material which has a compartment closed off at one end for housing a sensitive explosive material which is more sensitive than the usual bulk explosive charges to be detonated. Also included in the primer unit is a passageway which is open at both ends of the shell for receiving and housing an electric blasting cap. This channel has an inwardly extending shoulder which reduces the inner diameter thereof but still permits the passage of a blasting cap therethrough. However when the cap and its leg wires are both laced through and lodged in the passageway the cap becomes wedged at the shoulder to hold it firmly in position within the device with the base charge end of the cap adjacent to the compartment containing the sensitive explosive material.

9 Claims, 6 Drawing Figures

EXPLOSIVE PRIMING DEVICE

BACKGROUND OF INVENTION

The development of sensitized water based explosives and techniques for loading ANFO in small diameter holes was prompted by the industry's desire to eventually eliminate nitroglycerine from their product lines. However, the sensitized water based explosives and ANFO generally lack the degree of sensitivity that is intrinsic to nitroglycerine based compositions. Both ANFO and the water based explosives are less sensitive to initiation and in the case of the water based explosives they have a tendency to become less sensitive at low temperatures. When initiated under border-line energy conditions, ANFO and the water based explosives are prone to detonate inefficiently and in some cases to fail. With most nitroglycerine sensitized explosives, the standard practice is to initiate with a No. 6 blasting cap. ANFO cannot be initiated reliably in this manner. Although some water based compositions are sensitive to a No. 6 blasting cap and are sometimes used in this fashion, the industry recognizes the need for a small primer with substantially greater power output for application with most non-nitroglycerine explosives.

A variety of explosive packages for use as primers is known in the art as disclosed, for instance, in U.S. Pat. Nos. 3,037,452; 3,212,438; 3,276,372; 3,371,606; 3,401,632; 3,431,849; 3,431,851; 3,614,928; 3,604,353 and 3,747,527.

The industry has developed and is marketing miniature plastic explosive primers for the intended use. The weight of these units varies up to 20 grams. The units are designed to fit snugly over a blasting cap. Some units are closed at one end, to prevent extending the base of the cap completely through the plastic explosive. If the base of the cap is extended through and beyond the plastic explosive, the cap will fail to initiate the primer. Other units are open at both ends for use with detonating cord or with a cap providing that the leg wires of the cap are threaded through the primer to hold the cap in place. However, the latter does not assure that the base of the longer caps cannot be extended beyond the primer.

SUMMARY OF THE INVENTION

The present invention involves the design of a small primer that can be initiated with a blasting cap or detonating cord. It is intended for use in detonating explosives that are not reliably sensitive to a blasting cap or a knot of detonating cord.

The unique feature of the invention involves the package and its use with electric blasting caps. As previously stated, a primer containing an enclosed passageway to accommodate a cap can be used in such a manner that the base charge of the cap can be inserted through and beyond the primer and result in failure of the primer. This problem can be solved by closing one end of the passageway in the primer. However, in this case the passageway dimensions would be critical; the diameter would have to be chosen to accommodate various size (diameter) caps and provisions would have to be made to give a lock snug fit with all caps. This would be necessary to prevent the accidental removal of the cap from the primer in the field. In addition, closure of the cap passageway would limit the use of the primer to caps and prevent its use with detonating cord.

It is therefore an object of this invention to provide a priming explosive package of such configuration, whereby, when assembled with the priming charge and the blasting cap, with its wires, the cap is locked firmly in position within the shell with the base charge of the cap being located immediately adjacent the priming explosive.

Another object of the invention is to provide a primer explosive assembly device consisting of a shell, a priming explosive, a blasting cap and blasting cap wires wherein the cap and wires cooperate with the shell configuration in such a manner as to firmly wedge the cap in place within the shell with the base charge end of the cap lying immediately adjacent the explosive priming charge.

An additional object of the invention is to provide a primer device which will accommodate electric caps which vary slightly in diameter.

Still another object of the invention is to provide primer explosive charge assembly of the above objects wherein the blasting cap cannot inadvertently fall out or become displaced from the primer shell but is locked in place within the primer device.

It is another object of the invention to provide a primary explosive package which can be used with a detonating cord.

Other objects and advantages of the invention will become more apparent from a study of the following drawings and description wherein.

DETAILED DESCRIPTION OF INVENTION

Figure 1:
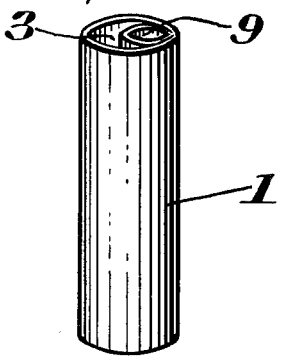
FIG. 1 is a perspective of the primer shell.

As shown in the drawings, the primer shell is preferably circular in shape. The shell 1 includes an elongated compartment 3 having an end wall 5. The compartment 3 is filled with a sensitive explosive material 7 such as Pentolite. Included in the shell 1 but walled off from the compartment 3 is channel or passageway 9 which is open at both ends of the shell. The bottom end of the passageway 9 has an inwardly extending shoulder 11 whereby the inner diameter of the passageway 9 is slightly reduced.

The primer shell 1 is used with electric blasting caps 13 which are smaller in diameter than the reduced inner diameter 11 of the passageway 9 at the bottom end thereof. The caps 13 can slide easily and completely through the passageway 11. However, when the cap 13 and its wires or leads 15 are laced through the passage in a manner to be explained, the combined effective diameter of the cap with the wires is greater than the reduced diameter 11 of the passageway 9 whereby the cap is wedged or locked in place within the passageway with the base charge of the cap abuting the inwardly extending lip 11 of the passageway 9.

Figure 5:
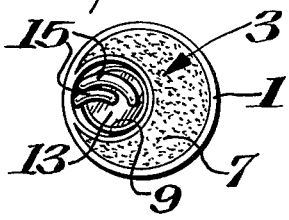
FIG. 5 is a top view of the shell assembly shown in FIG. 4.
Figure 3:
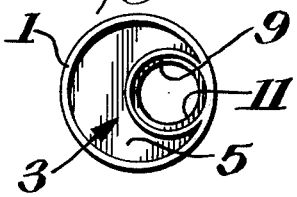
FIG. 3 is an enlarged top view of the shell of FIGS. 1 and 2.
Figure 2:
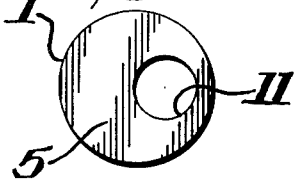
FIG. 2 is an enlarged bottom view of the shell of FIG. 1.
Figure 4:
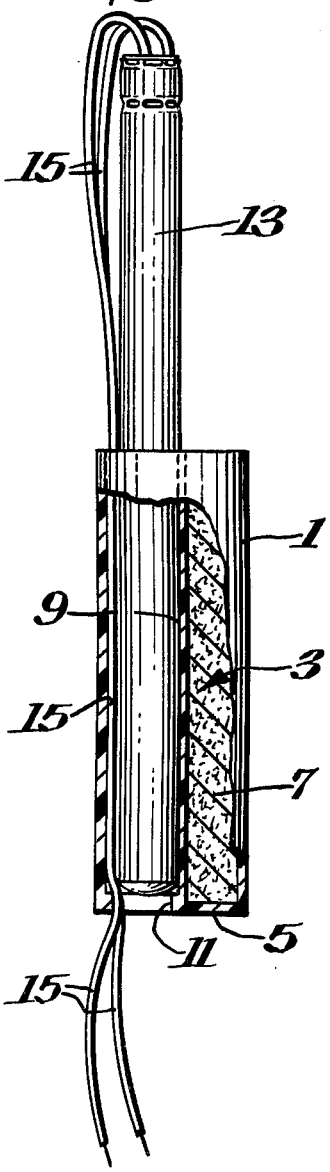
FIG. 4 is a side elevational view of the shell partially broken away showing the blasting cap and cap wires supported in place with one type of lacing pattern for the cap and wires.
Figure 6:
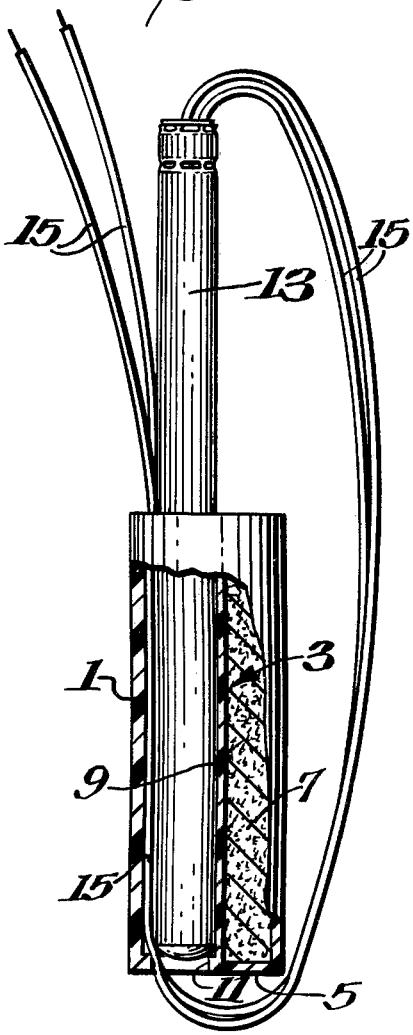
FIG. 6 is a side elevational view partially broken away showing the assembled shell cap and cap wires with the cap and wires assuming a lacing pattern different than that of FIGS. 4 and 5.

FIGS. 4 and 5 illustrate one assembled form of the primer shell, priming explosive, blasting cap and cap wires or leads while FIG. 6 illustrates still another assembled form or arrangement. In FIGS. 4 and 5 the wires 15 extend from the end of the cap 13 to which they are attached directly down through passageway 9 to exit through the passageway opening 11 at the bottom of the passage. The base charge end of the cap seats upon the shoulder 11 and is jammed or locked in place against the wires 15 which further reduce the effective inner diameter of the passageway opening to such a dimension that the cap 13 cannot pass therethrough.

To achieve this arrangement (FIG. 4) the free end of the cap 13 is inserted into the bottom end of the passageway 9 and pulled upwardly out through the top end of the passageway 9. Its position is then reversed and the free end of the cap is inserted in the top end of the passageway 9 and pushed down until it abuts the inwardly extending shoulder 11 at the bottom end of the passageway where it is jammed or wedged against the wires to hold the cap in locked position.

As for the embodiment shown in FIG. 6, the free end of the cap 13 is inserted through the top end of the passageway 9 after which it is drawn through and out of passageway 9. It is then looped around and reintroduced into the same end of the passageway 9. Again since the wires are now laced through the passageway 9, the end of the cap abuts the reduced diameter 11 portion of the passageway 9 to become wedged or locked in place with the base charge end of the cap lying adjacent to the explosive charge 7.

Preferably the shells are made of a rigid form retaining synthetic plastic material such as cellulose acetate, cellulose acetate butyrate, cellulose propionate, cellulose acetate propionate, cellulose butyrate, polyvinyl chloride, polyethylene, polypropylene, polyamides, polyvinyl butyral, polystyrene, polyacrylonitrile, copolymers of vinyl chloride and other polymerizable monomers, such as vinylidene chloride and vinyl acetate, polymethymethacrylate, polyesters and thermoplastic synthetic rubbers. The shell may be formed through common molding processes such as injection molding, transfer molding, and the like.

The primer shells of the invention can be filled with any type of sensitive explosive, such as Pentolite (a mixture of pentaerythritol tetranitrate (PETN) and trinitrotoluene), ammonium dynamite, nitroglycerine dynamite, semi-gelatin and gelatin dynamites, gelled nitromethane, composition B, RDX (Cyclonite or cyclotrimethylenetrinitramine), Tetyl, Beta-HMX and pentacrythritol tetranitrate, ammonium perchlorate, as well as others known in the trade.

It is normally preferable to employ a cast priming charge, which is filled into the container while molten and allowed to harden in the container.

If desired, a detonating fuse cord such as Primacord (such as 50grain/ft.) can be used instead of a cap. The cord is threaded through the passageway 9 from either end and then knotted at the free end. The knot positioned externally of the passageway opening is formed large enough to prevent it from entering the passageway and thus prevents the primer package from slipping off the knotted end of the detonating cord.

In the drawings, the passageway 9 is shown off-center, however, it could be concentric. Also, the inwardly extending shoulder 11 is shown at the end of the cartridge. It can be located at either end or at any location along the well. The reduced diameter of the passageway 9 is based upon the best compromise of cap and leg wire diameters. Also, the package could have an external size or shape other than that shown in the drawings and described above.

What is claimed is:

1. A primer unit for explosive materials comprising an elongated shell having a top and a bottom end, a compartment within said shell for housing explosive material, said compartment being walled off at the bottom end of the shell, a walled passageway which accommodates therein a No. 6 electric blasting cap and its lead wires when threaded through said passageway, said passageway extending completely through the shell structure endwise thereof, and an inwardly extending shoulder within the passageway which reduces the inner diameter of the passageway to a dimension which will allow said No. 6 cap by itself to pass through the reduced diameter opening but which prohibits the cap from passing through when the cap and its lead wires threaded completely through the passageway occupy the passageway.

2. The primer unit of claim 1 wherein the shoulder is positioned at one end of the passageway.

3. The primer unit of claim 1 wherein the shoulder is positioned inwardly of one end of the passageway.

4. An explosive primer device assembly comprising an elongated shell having a top and bottom end, a compartment within such shell, said compartment being walled off at the bottom end of the shell, an explosive material housed in said compartment, a walled passageway extending completely through the shell being open at both ends of the shell, an inwardly extending shoulder in said passageway, a blasting cap having lead wires attached to one end thereof positioned within said passageway, said lead wires also being threaded through said passageway, the reduced diameter portion of said passageway being large enough for the blasting cap to pass therethrough by itself but prohibited from such passage when the lead wires are also threaded through the passageway whereby the blasting cap is wedged at the reduced diameter portion of the passageway to lock the cap in position in the shell.

5. The assembly of claim 4 wherein the shoulder is positioned at one end of said passageway.

6. The assembly of claim 4 wherein the explosive material within the compartment is solidified Pentolite.

7. The assembly of claim 4 wherein the shoulder is positioned inwardly of one end of the passageway.

8. The assembly of claim 4 wherein the end of the cap to which the lead wires are attached extends above the top end of the shell, and the cap lead wires extend directly into the top end of and downwardly through the passageway.

9. The assembly of claim 4 wherein the end of the cap to which the lead wires are attached extends above the top end of the shell, and the cap lead wires extend directly into the bottom end of and upwardly through the passageway.

* * * * *